US008444399B2

(12) United States Patent
West et al.

(10) Patent No.: US 8,444,399 B2
(45) Date of Patent: May 21, 2013

(54) PUMP SYSTEM FOR CONVEYING A FIRST FLUID USING A SECOND FLUID

(75) Inventors: Robert Leslie West, Hillarys (AU); Gordon Leith Morriss, Bicton (AU)

(73) Assignee: Weir Minerals Netherlands B.V., Venlo (NL)

( * ) Notice: Subject to any disclaimer, the term of this patent is extended or adjusted under 35 U.S.C. 154(b) by 279 days.

(21) Appl. No.: 12/738,493

(22) PCT Filed: Oct. 15, 2008

(86) PCT No.: PCT/NL2008/000225

§ 371 (c)(1),
(2), (4) Date: Jul. 19, 2010

(87) PCT Pub. No.: WO2009/051474

PCT Pub. Date: Apr. 23, 2009

(65) Prior Publication Data

US 2010/0278669 A1 Nov. 4, 2010

(30) Foreign Application Priority Data

Oct. 17, 2007 (AU) ..... 2007905696

(51) Int. Cl.
*F04B 23/04* (2006.01)

(52) U.S. Cl.
USPC ..... 417/522; 417/521; 417/533

(58) Field of Classification Search
USPC ..... 417/521, 522, 531, 533
See application file for complete search history.

(56) References Cited

U.S. PATENT DOCUMENTS 3,910,727 A 10/1975 Flynn
4,645,599 A 2/1987 Fredkin
4,756,830 A * 7/1988 Fredkin ..... 210/321.66

FOREIGN PATENT DOCUMENTS

FR 1329131 6/1963
WO WO-2004/011806 2/2004

* cited by examiner

*Primary Examiner* — Charles Freay
*Assistant Examiner* — Patrick Hamo
(74) *Attorney, Agent, or Firm* — Muncy, Geissler, Olds & Lowe, PLLC

(57) ABSTRACT

A pump system for conveying a first fluid using a second fluid. The system includes at least a first pump having at least a first rigid outer casing defining a first interior space and a first flexible tube structure accommodated in the first interior space. The interior of the first flexible tube structure is arranged for receiving one of the first or second fluids. The region of the first interior space surrounding the first flexible tube structure is arranged for receiving the other of the first and second fluids. The first flexible tube structure is movable between laterally expanded and collapsed conditions for varying the volume of the interior of the first flexible tube structure, thereby imparting sequential discharge and intake strokes on the first fluid.

18 Claims, 2 Drawing Sheets

PUMP SYSTEM FOR CONVEYING A FIRST FLUID USING A SECOND FLUID

TECHNICAL FIELD

A system and apparatus are disclosed for the pumping of a fluid. The system and apparatus find particular application to the pumping of particulate slurries. However, it should be appreciated that the method and apparatus can be applied to fields as diverse as hydraulic hoisting, integrated cooling and dewatering systems, and reverse osmosis desalination

BACKGROUND ART

There are a range of technologies available that allow fluid pressure to be used to pump other fluids. These devices are, in essence, pressure exchange devices, and can also be used to extract pressure from fluids.

The Seimag 3 chamber pipe, DWEER and ERI systems (discussed in further detail below) are fluid pressure exchange systems in which the fluids can interact (i.e. to mix) to some extent.

There is a broad family of other fluid pressure exchange devices that have a membrane (flexible hose) inside a rigid pipe to define an annulus (between the hose and the pipe) and a volume (within the hose). The annulus and volume can be used to exchange or recover energy between two fluids and at the same time keeping the fluids separated to prevent mixing and improve energy transfer efficiency. Energy transfer in these pumps is typically through a positive displacement action.

Examples of such pumps are described in the following patent applications and patents: PCT/AU2003/000953 (West and Morriss), GB 2,195,149A (SB Services), WO 82/01738 (Riha), U.S. Pat. No. 6,345,962 (Sutter), JP 11-117872 (Iwaki), U.S. Pat. No. 4,543,044 (Simmons), U.S. Pat. No. 4,257,751 (Kofahl), U.S. Pat. No. 4,886,432 (Kimberlin), GB 992,326 (Esso), U.S. Pat. No. 5,897,530 (Jackson).

Of these, the pump described in PCT/AU2003/000953 (West and Morriss) has achieved commercial application in the mining industry. In its typical use, a dirty or corrosive fluid is pumped inside the flexible hose, under low pressure, and another fluid such as hydraulic oil is pumped into the annulus at high pressure—causing the dirty or corrosive fluid to exit the hose under high pressure. The use of hydraulic oil as the energy source, allows the energy to be efficiently developed in a clean, long life environment.

Some other typical applications using energy exchange devices are as follows.

(i) Hydraulic Hoisting

Hydraulic hoisting is the principle of pumping a slurried mineral ore (or similar) from a depth within a mine, either to the surface or a higher level in the mine. The mine may be either open cut or underground. Typical alternative methods of removing ore from mines are by hoisting in a skip, by conveyor, or by dump truck. Hydraulic hoisting should in principle provide a lower life cycle cost than these alternatives—but is yet to establish a significant position in the market place.

Existing forms of hydraulic hoisting generally consist of;

1. Using a piston diaphragm or other high pressure pump to pump a homogeneous slurried ore to the surface of a mine. In this case, the slurry is pumped to the surface, and nothing is returned or recirculated back to the original pumping point, and hence no pressure recovery is possible; or
2. Using a three chamber pipe system (eg. Siemag type system) to pump a slurried ore to the surface of a mine, but using recirculated water from the surface to assist in pumping the slurry. The 3-chamber system relies on sequentially filling and discharging 3 chambers with slurry and then water.

Within this system, one chamber is initially filled with slurry, before discharging it under high pressure with water. During the discharge stroke, another chamber is filled with slurry, then discharged by the high pressure water, while the third chamber is being filled. The process then continues with this third chamber discharging and the first chamber filling, in an on-going sequence.

Although this system recovers energy from the recirculated water, mixing can occur between the two mediums, which also results in energy losses and dilution or contamination of the slurry. Also, it is usually necessary to apply additional energy to the system to hoist the slurry from the mine due to the density differences between the water and the slurry and due to friction losses in the system.

Some hydraulic hoisting systems have been proposed where a dense slurry media is used as the carrier for pumping the ore to be removed from the mine (in a particulate form), and pressure is recovered from the dense media as it is recirculated back into the mine. (eg via a 3-chamber pipe system) (see: Hydraulic Hoisting for Platinum Mines, 2004, Robert Cooke et al).

As noted, in many of the pressure recovery circuits, make-up flow and or pressure must be applied to the circuit to maintain pressure and flow balances.

(ii) Integrated Cooling and Dewatering Systems

In these integrated systems, water is typically cooled on the surface of the mine, then pumped underground. As a result of which, it develops considerable (potential) energy. This energy is recovered in three chamber pipe systems or Pelton wheel type systems and used to help pump dirty water from the mine.

(iii) Reverse Osmosis

In sea water reverse osmosis systems, the salty sea water is usually brought up to around 7,000 kPa (1000 psi) through multi-stage centrifugal pumps. The pressurised water is then fed into reverse osmosis membrane chambers, from which clean water exits on one side of the membrane, and a high salt concentration water exits from the other side. The high salt concentration water is still at high pressure, but approximately half the flow rate of the sea water inflow.

Various pressure recovery systems exist to recover the energy from the high salt concentration water, (eg. DWEER (solid floating piston in pipe) and ERI (rotating liquid piston systems)). These either allow some level of mixing to occur between the two mediums, or have the potential for friction (between the solid piston and walls) which together result in energy and efficiency losses. Also the use of multi-stage pumping as the primary pumping mechanism is not the most efficient technology available at these pressures.

SUMMARY OF THE INVENTION

In a first aspect the present invention provides a pump system for conveying a first fluid using a second fluid, comprising at least a first pump, said first pump consisting of at least:

a first rigid outer casing defining a first interior space, a first flexible tube structure accommodated in the first interior space, wherein the interior of the first flexible tube structure is arranged for receiving one of said first or second fluids, wherein the region of the first interior space surrounding the first flexible tube structure is arranged for receiving said other of said first and second fluids, and wherein the first flexible tube structure being movable between laterally expanded and collapsed conditions for varying the volume of the interior of the first flexible tube structure, thereby imparting sequential discharge and intake strokes on said first fluid, characterized in that the pump system comprises a second pump, said second pump consisting of at least a second rigid outer casing defining a second interior space, a second flexible tube structure accommodated in the second interior space, wherein the interior of the second flexible tube structure is arranged for receiving one of said second or a third fluid being displaced by said imparted sequential discharge and intake strokes of said first pump, wherein the region of the second interior space surrounding the second flexible tube structure is arranged for receiving said other of said second and third fluids being displaced by said imparted sequential discharge and intake strokes of said first pump, and wherein the second flexible tube structure being movable between laterally expanded and collapsed conditions for varying the volume of the interior of the second flexible tube structure, thereby imparting sequential discharge and intake strokes on said third fluid.

The integration of an a energy recovery device and a pressure pumping device together provides a system capable of recovering energy from a first fluid and transferring it to a second fluid, then using this energy in the second fluid, together with additional external energy and/or flow applied to the second fluid, to pump a third fluid at higher pressure and/or flow rate than the first fluid. The third fluid may be the same of fluid type as the first fluid.

This type of integrated system is envisaged to be used in applications such as:

Hydraulic hoisting,

Integrated cooling and dewatering systems, and

Reverse Osmosis desalination

In each of these applications a fluid is required to be pumped at high pressure and high flow rate through a process or from one point to another. Once the pumped fluid gets to its destination, or has been processed, it may still contain considerable energy or may be able to be returned to its starting point and regain considerable (potential) energy. This energy may be available to help pump more of the original fluid if the energy can be efficiently extracted. This type of system can be thought of as a closed or semi-closed loop recirculating system.

Alternatively, there may be an additional source of fluid containing considerable energy that is available to help pump the pumped fluid. This type of system may be thought of more as an open loop system.

Of particular concern with such energy recovery and pumping systems is to ensure that:

The maximum amount of energy is recovered from the fluid source,

The pumped fluid does not mix, or mixes minimally with the fluid source, and

The system for recovering the energy and pumping the pumped fluid is mechanically simple in principle.

The present invention overcomes some of the limitations of the known prior art combined pressure recovery and pumping systems by being able to increase the efficiency of the energy recovery, and handle a more diverse range of fluids, both in the energy recovery circuit and the pumped fluid circuit.

In one embodiment, the system may include a fluid flushing circuit which is arranged in fluid communication therewith for clearing particulate and other debris from the system.

In one embodiment, the system may include a control system is arranged for controlling the operation of the said valves and pumps in a pre-determined manner.

In a second aspect the present invention provides a pump system for conveying a second fluid by using movement of a first fluid, and in turn for conveying a third fluid using movement of the second fluid, the system comprising:

a first pump having a flexible internal barrier separating first and second fluids in use, wherein the flexible barrier is movable to vary the volume of first or second fluid present within the pump at any one time, and a second pump having a flexible internal barrier separating second and third fluids in use, wherein the flexible barrier is movable to vary the volume of second or third fluid present within the pump at any one time, characterized in that an imparted sequential discharge and intake stroke from said first pump which results in movement of the second fluid forms a part of the imparted sequential discharge and intake stroke of the second pump.

In one embodiment, the flexible barrier can be a tube structure.

In one embodiment, the system may be otherwise as defined in the first aspect.

BRIEF DESCRIPTION OF THE DRAWINGS

Notwithstanding any other forms which may fall within the scope of the method and apparatus as set forth in the Summary, a specific embodiment of the method and apparatus will now be described, by way of example, and with reference to the accompanying drawings in which.

DETAILED DESCRIPTION OF SPECIFIC EMBODIMENTS

The invention comprises a pump system which can operate with one, two or more chambers The invention may operate with one, two or more chambers configured to recover energy, usually configured in pairs. These are positive displacement devices, consisting of a hose like membrane within a rigid pipe (chamber), to define an annulus (between the hose and the pipe) and a volume (within the hose). The hose is flexible, but generally not elastic. It may be held taut, be held fixed in place at the ends or be freely suspended in the chamber.

Figure 1:
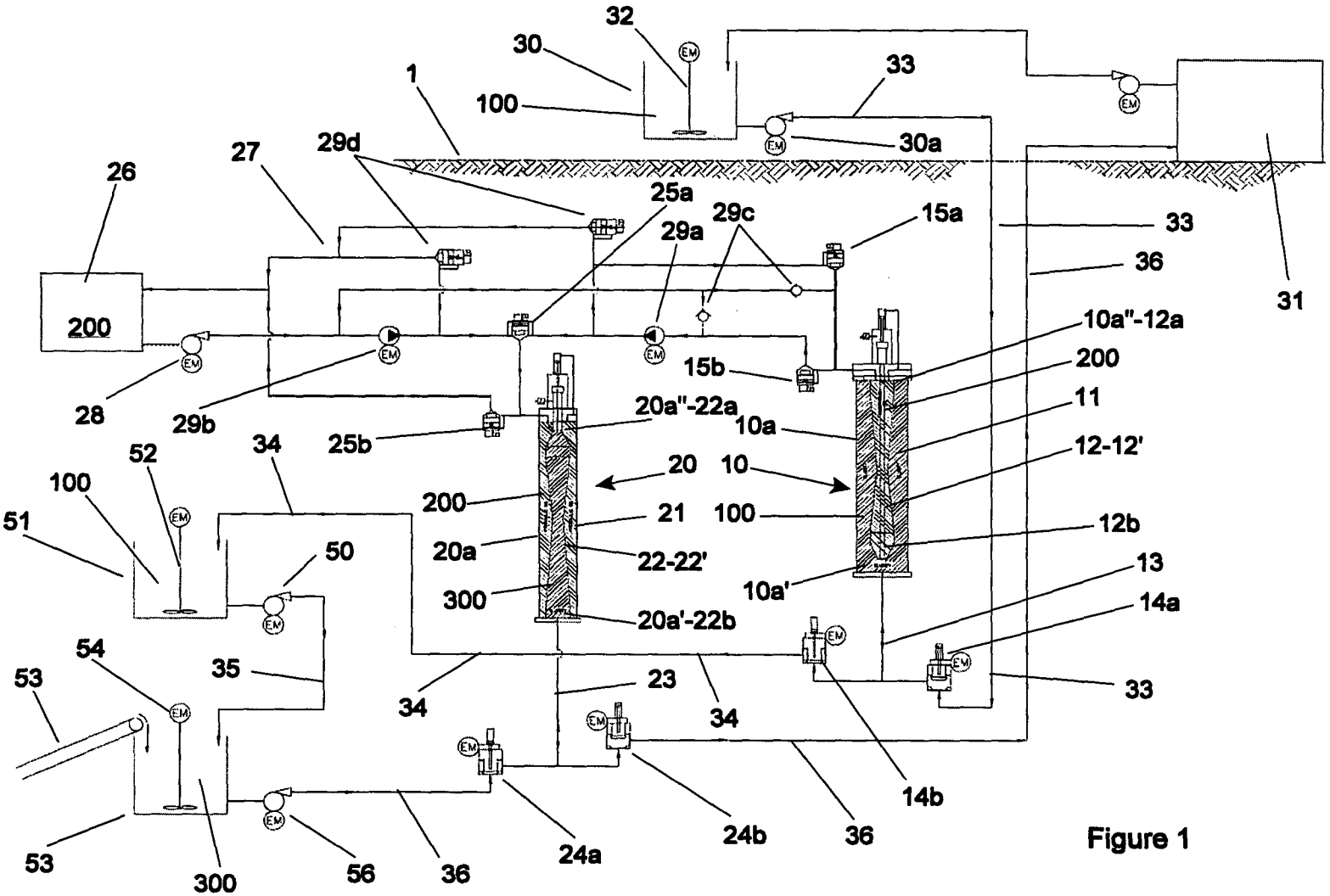
FIG. 1 shows a configuration of a system suitable for hydraulic hoisting particulate ore using a recirculated, homogeneously slurried carrier fluid.

In a first embodiment as disclosed in FIG. 1 reference numeral 10 depicts a first pump consisting of at least a first, rigid outer casing 10*a* defining a first interior space or annulus 11, which is filled with the first fluid (a slurried carrier fluid in FIG. 1 and indicated with reference numeral 100). In the outer casing 10*a*—annulus 11*a* first flexible tube or hose 12 is accommodated, which hose 12 defines a first volume 12' is filled with the second fluid (oil or another suitable fluid for recovering and transferring energy and indicated with reference numeral 200). The first annulus 11 has both first fluid inlet (14*a*) and first fluid outlet (14*b*) valves connected to it via an inlet/outlet pipe line 13 to allow the first fluid 100 to flow in and out the annulus 11 (slurry inlet and outlet valves

14*a*-14*b* in FIG. 1). The first fluid inlet valve 14*a* communicates via pipe line 33 with a high pressure source 30 of the first fluid 100, being supplied from the carrier storage tank 30 on the surface (or ground level) 1. The first fluid outlet valve 14*b* communicates via a pipe line 33 with a low pressure sink 51 of the first fluid 100, functioning as a carrier surge tank 51 in FIG. 1.

The volume 12' within the first flexible tube or hose 12 also has second fluid inlet (15*a*) and second fluid outlet (15*b*) valves connected to it to allow the second fluid 200 to flow in and out from supply tank 26, via hydraulic pump 28 and pipe line system or hydraulic circuit 27 (inlet valve and outlet valves 15*a*-15*b* in FIG. 1).

In some embodiments there can be more than one inlet valve and/or more than one outlet valve, depending on the configuration and the operational circumstances.

For both first and second fluids 100 and 200, the flows in and out the chamber may be from the same end or from different ends (10*a*'-10*a*"; 12*a*-12*b*), depending on the application.

The normal sequence of operation for the energy recovery chamber is as follows:

The second fluid 200 enters and fills the hose 12 at low pressure through its second fluid inlet valve(s) 15*a*. The first flexible tube or hose 12 is filled to a desired extent. As the second fluid 200 enters the hose 12, it displaces an equivalent volume of either air or the first fluid 100 from the first interior space or annulus region 11. The first fluid 100 exits the first rigid outer casing 10*a* (and first interior space or annulus 11) via a first fluid outlet valve 14*b* (or valves, powered valves in FIG. 1) to a tank (surge tank 51 in FIG. 1) under low pressure. Air is bled from the annulus 12 via an additional valve(s) if necessary (not shown).

First fluid inlet valve(s) 14*a* (powered valves in FIG. 1) connecting the first interior space or annulus 11 to the source 30-30*a* of pressurised first fluid 100 are then opened to allow the first fluid 100 to enter the annulus 11 under pressure. As it enters the annulus 11, the first fluid 100 displaces an equivalent volume of second fluid 200 back to the hydraulic circuit 27, under pressure from the first flexible tube or hose 12. In FIG. 1, the first fluid (the carrier fluid) 100 is under pressure as a result of the vertical head of carrier fluid rising up to the surface 1 of the mine site in pipe line 33.

Prior to the first fluid 100 entering the annulus 11, the second fluid 200 inside the hose 12 may be pressurised via a pumping device 29*a* in the second fluid circuit 27 to a pressure equal to or substantially equal to the first fluid operating pressure, so that when the inlet valve(s) 14*a* joining the annulus 11 to the pressurised first fluid 100 are opened, the valves 14*a* open with no or limited pressure differential. Flow control is achieved by controlling the flow of second fluid 200 from the hose 12. This significantly reduces wear on the inlet valves 14*a* of the first fluid circuit or pipe lining 33 and achieves a smooth pressure and flow profile in a multi-chamber system. Once the second fluid 200 in the first flexible tube or hose 12 has been displaced to a desired extent, the flow of the second fluid 200, and hence the flow of the first fluid 100, is stopped.

The process is then repeated, that is, the first fluid 100 (fluid from which the potential energy has being recovered) is again displaced from the annulus 11 to the (surge) tank 51, by the action of the low pressure second fluid 200 entering the first flexible tube or first hose 12. As it flows from the energy recovery chamber 10, the pressurised second fluid is available in the second fluid circuit 27 for use in the main pumping chamber 20.

In a multi-chamber system, the process of alternately filling and displacing first and second fluids (100-200) is sequenced such that as one chamber 10 is being filled with first fluid, another chamber 20 is discharging its depressurised first fluid 100 to the low pressure tank 51, such that there is a continuous or near continuous flow of both first 100 and second 200 fluid in and out of the combination of chambers (10-11-12; 20-21-22).

The invention may operate with one, two or more chambers configured as fluid operated pumps (10; 20), usually in pairs. Like the energy recovery chambers or the first pump (10-11-12), a further pump (20-21-22) consist of a second flexible tube or hose like membrane 22 within a second rigid outer casing or rigid pipe (chamber) 20*a*, to define a second interior space or second annulus 21 (between the hose 22 and the pipe 20*a*, indicated with reference numeral 21) and a second volume 22' (within the second flexible tube or hose 22). The second hose 22 is flexible, but generally not elastic. It may be held taut, be held fixed in place at the ends 22*a*-22*b* or be freely suspended in the chamber or second interior space 21.

The second annulus 21 is filled with the second fluid 200 (eg. oil or another suitable fluid for recovering and transferring energy) and the second flexible tube or hose 22 is filled with the third fluid 300 (in the example, a non homogenous mix of the carrier fluid and particulate ore). The volume 22' within the hose 22 has both inlet 24*a* and outlet 24*b* valves connected to it to allow the third fluid 300 to flow in and out (third fluid slurry inlet 24*a* and third fluid outlet valves 24*b* in FIG. 1). The third fluid inlet valve 24*a* communicates with a low pressure supply line 36 of the third fluid 300 from the carrier and ore mixing tank 53 in FIG. 1. The third fluid outlet valve 24*b* communicates with the high pressure delivery line 37 of the third fluid circuit for delivery to the process plant 31 in FIG. 1.

The carrier and ore mixing tank 53 is in fluid communication with the surge tank 51 via an intermediate pipe line 35. First fluid 100 enters at low pressure surge tank 51 via pipe line 34. In the surge tank 51 first fluid 100 is continuously mixed using mixing element 52 and transferred via slurry pump 50 and intermediate pipe line 35 towards the carrier and ore mixing tank 53. Via supply means 55 ore is added to tank 53 and mixed with the first fluid 100 using mixing element 54. The mixing result 300 consists of slurry and ore and is subsequently transported via slurry pump 56 and low pressure supply line 36 towards the third fluid inlet valve 24*a* as third fluid 300.

The second interior space or annulus 21 of the main pumping chamber(s) (second rigid outer casing 20*a* of second pump 20) has second fluid inlet 25*a* and second fluid outlet 25*b* valves connected to it to allow the second fluid 200 to flow in and out (hyd. inlet and hyd. outlet valves 25*a*-25*b* in FIG. 1).

For both the second 200 and third 300 fluids, the flows in and out the chamber or second pump 20 (especially second interior space 21 and second flexible tube 22) may be from the same end or from different ends (20*a*'-20*a*"; 22*a*-22*b*).

The normal sequence of operation is as follows: the third fluid 300 is pumped inside the second flexible tube or hose 22, under low pressure via pipe line 36, third fluid inlet valve 24*a* and third fluid delivery line 23. The second fluid 200 (eg. hydraulic oil) is then pumped into the second interior space or annulus 21 at high pressure, causing the third fluid 300 to exit the hose 22 under high pressure through third fluid delivery line 23, the third fluid outlet valve 24*b* to the delivery line 37 and towards to the process plant 31 at ground level 1.

Check valves 24*a*-24*b* may be used to control the flow of the third fluid 300 in and out of the hose 22, however, powered control valves 24*a*-24*b* are likely to be required in a hydraulic hoisting situation where the third fluid 300 is a non-homogeneous mix of a carrier fluid 100 with particulate ore or other hard particulate material.

Prior to the third fluid 300 exiting the hose 22, the second fluid 200 inside the second interior space or annulus 21 may be pressurised via a pumping device 29*b* in the second fluid circuit 27 to be equal to or substantially equal to the pressure of the third fluid delivery line 36-23. This ensures that when the valves 25*a*-25*b* joining the annulus 21 to the second fluid circuit 27 are opened and the valves 24*a*-24*b* joining the volume 22' within the hose 22 to the third fluid delivery line 23 also open, both sets of valves open with no or limited pressure differential. This reduces wear over the valves, and also ensures a smooth pressure and flow profile in the delivery line 23 of the third fluid 300 in a multi-chamber system.

Once the pressurised second fluid 200 has been allowed to fill the annulus 21 to a desired extent and displace a known quantity of third fluid 300, the flow of the second fluid 200 is stopped, which stops the flow of the third fluid 300 through its outlet valve 24*b* and the delivery line 37.

The process then repeats itself, as a new volume of the third fluid 300 is pumped into the hose 22 at low pressure via pipe line 36, third fluid inlet valve 24*a* and delivery line 23, displacing the second fluid 200 back to a tank 26 (the hydraulic tank 26 in FIG. 1) at low pressure ready for the next cycle.

In a multi-chamber system, the process of alternately filling and displacing second and third fluids is sequenced such that as one chamber is being filled with third fluid 300, another chamber is discharging its pressurised third fluid to the delivery line 23-37, such that there is a continuous or near continuous flow of the third fluid 300 out of the combination of chambers.

In the Figure as shown, the main pumping chambers 10-20 are configured using the positive displacement pump described in PCT patent application PCT/AU2003/000953, the text of which is incorporated herein in its entirety by reference, and a variant of this type of pump is used for the energy recovery chambers.

A key feature of the invention, is the combination of the pressurised second fluid arising from the energy recovery chambers, with additional pressurised second fluid arising from a conventional (hydraulic) pumping system, and/or increasing the pressure of the second fluid arising from the energy recovery chambers, such that there is sufficient second fluid (oil) flow and pressure to match the requirements of the fluid to be pumped (ie. the third fluid).

In the example shown, the volume of first fluid 100 (the slurried carrier fluid) being handled per unit of time is less than the volume of third fluid 300 (ie. the combined volume of carrier fluid and particulate ore) being pumped at the same time.

This requires that additional second fluid 200 (oil) volume be introduced to the second fluid (hydraulic) circuit 27, to make up for the short fall in the second fluid flow arising from the energy recovery chamber. Also, in the example shown, the pressure required to pump the third fluid is greater than the pressure arising from the first fluid in the energy recovery chamber (because the third fluid is more dense than the first (carrier) fluid alone). The second fluid arising from the energy recovery chamber must therefore be boosted in pressure to the pressure required by the third fluid delivery line.

This boost in pressure can be achieved by the use of one or more conventional pumps in the second fluid (hydraulic) circuit between the energy recovery chamber and the main pumping chamber (Hydraulic pump 29*a* in the example).

The additional second fluid 200 (oil) volume required to make-up the volume flow, is provided at this higher, third fluid delivery line pressure by a separate hydraulic pump(s) 29*b*.

Various valves 29*c* are located in the second fluid circuit 27 to ensure effective and safe operation. One or more accumulators 29*d* may be provided in the second fluid circuit 27 to provide pressure and flow damping.

A flushing circuit (not shown) is required in some applications, typically slurry applications, where there is a possibility of the third fluid settling or hardening or aggressively reacting with materials, if left in the system upon shut down. The flushing system would typically use water and flush the annulus area of the energy recovery chamber(s), the hose area of the main pumping chamber(s), and selected sections of the first and third fluid lines, either on shutdown, on start-up or both.

Control System

The pump system according to the invention is controlled by an electronic control system (or other type of controller) that sequences the flows in and out of the energy recovery chamber(s), and the flows in and out of the main pumping chamber(s) through controlling the operation of the pumps and valves in the system.

In a multi-chamber system, it is not necessary that the cycling and sequencing of the energy recovery chambers be synchronised to match that of the main pumping chambers.

In a system with just a single pressure recovery chamber and a single main pumping chamber, the sequencing of the chambers should ideally be synchronised.

The control system also controls the start-up and shut down sequencing of the system, the flushing circuit, an operator interface and any bleed circuits required to bleed air from the system to ensure positive displacement action.

Alternative Configurations

In a typical reverse osmosis system—the third fluid pressure (sea water) is the same as the first fluid pressure (the high salt concentration water)—so there is no requirement for a boost pressure pump in second fluid circuit between the energy recovery chamber and the main pumping chamber.

There is however a difference in flow rate (the third fluid flow rate is approximately double the first fluid flow rate), and additional pressurised second fluid is required to be provided to the circuit to provide sufficient third fluid flow.

Figure 2:
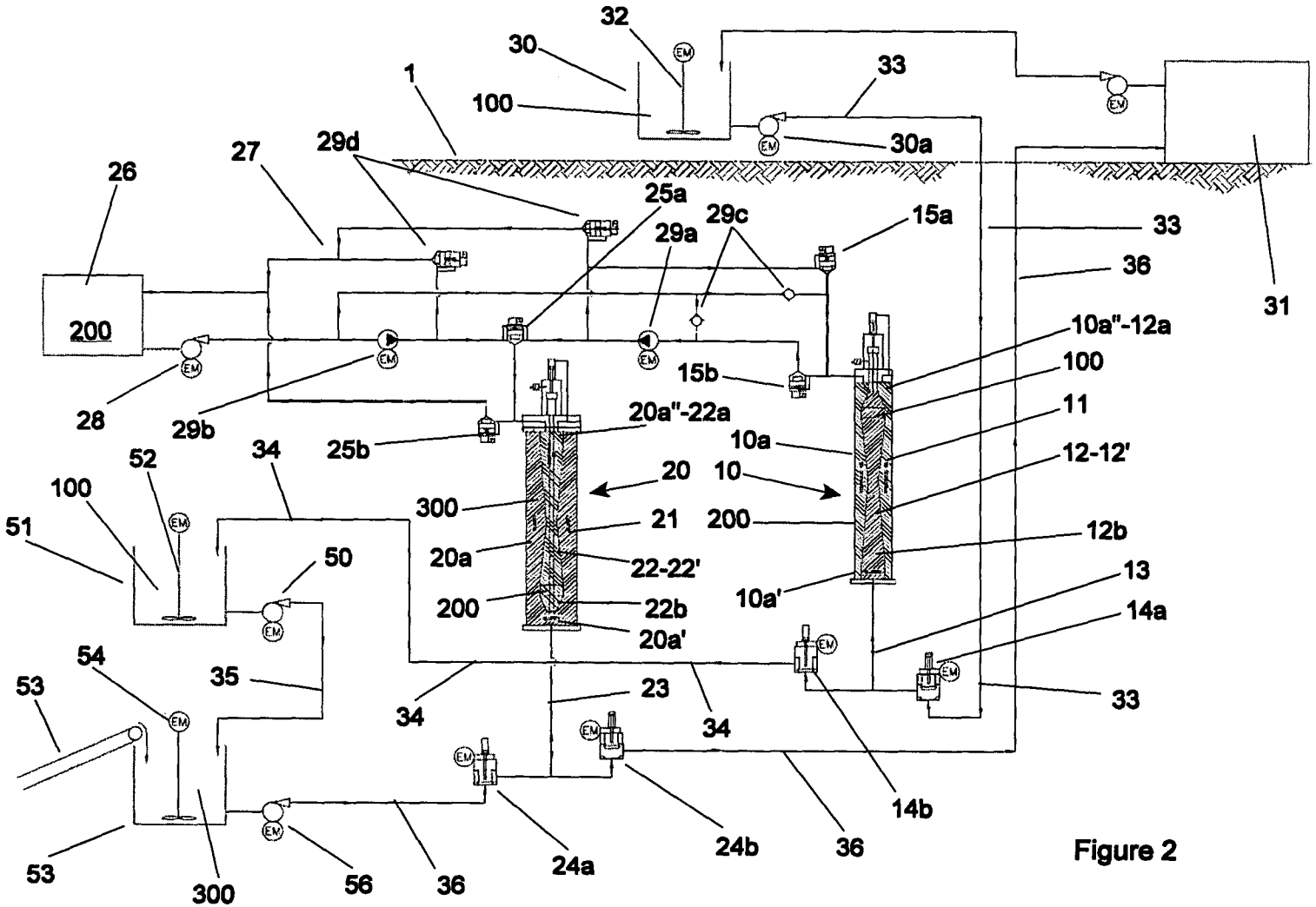
FIG. 2 shows another configuration of a system suitable for hydraulic hoisting particulate ore using a recirculated, homogeneously slurried carrier fluid

In yet another embodiment as shown in FIG. 2 the first pump 10 and second pump 20 are exchanged.

Likewise reference numeral 10 depicts a first pump consisting of at least a first, rigid outer casing 10*a* defining a first interior space or annulus 11, which is now to be filled with the second fluid 200. In the outer casing 10*a*—annulus 11*a* first flexible tube or hose 12 is accommodated, which hose 12 defines a first volume 12' and is to be filled with the first fluid (oil or another suitable fluid for recovering and transferring energy and indicated with reference numeral 100). The hose 12 has both first fluid inlet (14*a*) and first fluid outlet (14*b*) valves connected to it via an inlet/outlet pipe line 13 to allow the first fluid 100 to flow in and out the hose 12 (slurry inlet and outlet valves 14*a*-14*b* in FIG. 2).

Likewise the further second pump (20-21-22) consist of a second flexible tube or hose like membrane 22 within a second rigid outer casing or rigid pipe (chamber) 20*a*, to define a second interior space or second annulus 21 (between the hose 22 and the pipe 20*a*, indicated with reference numeral 21) and a second volume 22' (within the second flexible tube or hose 22).

The second annulus 21 is filled with the third fluid 300 and the second flexible tube or hose 22 is filled with the second fluid 200. The hose 22 has both second fluid inlet 25*a* and second fluid outlet 25*b* valves connected to it to allow the second fluid 200 to flow in and out.

Whereas the third fluid 300 is pumped inside the second interior space or annulus 21, under low pressure via pipe line 36, third fluid inlet valve 24*a* and third fluid delivery line 23. The second fluid 200 (eg. hydraulic oil) is then pumped into the second flexible tube or hose 22 at high pressure, causing the third fluid 300 to exit the annulus 21 under high pressure through third fluid delivery line 23, the third fluid outlet valve 24*b* to the delivery line 37 and towards to the process plant 31 at ground level 1.

Apart from the fact that the configurations of both first and second pumps 10-20 are exchanged, the functionality of the pump system according to this second embodiment is identical to that of FIG. 1.

Whilst the method and apparatus has been described with reference to a preferred embodiment, it should be appreciated that the method and apparatus can be embodied in many other forms.

In the claims which follow and in the preceding description, except where the context requires otherwise due to express language or necessary implication, the words "comprise" and variations such as "comprises" or "comprising" are used in an inclusive sense, i.e. to specify the presence of the stated features but not to preclude the presence or addition of further features in various embodiments of the method and apparatus.

The invention claimed is:

1. A pump system for conveying a first fluid using a second fluid, the system comprising:

at least a first pump, said first pump comprising at least a first rigid outer casing defining a first interior space and a first flexible tube structure accommodated in the first interior space, wherein the interior of the first flexible tube structure is arranged for receiving one of said first or second fluids, the region of the first interior space surrounding the first flexible tube structure is arranged for receiving said other of said first and second fluids, and the first flexible tube structure is movable between laterally expanded and collapsed conditions for varying the volume of the interior of the first flexible tube structure, thereby imparting sequential discharge and intake strokes on said first fluid, a second pump, said second pump comprising at least a second rigid outer casing defining a second interior space and a second flexible tube structure accommodated in the second interior space, wherein the interior of the second flexible tube structure is arranged for receiving one of said second or a third fluid being displaced by said imparted sequential discharge and intake strokes of said first pump, the region of the second interior space surrounding the second flexible tube structure is arranged for receiving said other of said second and third fluids being displaced by said imparted sequential discharge and intake strokes of said first pump, and the second flexible tube structure is movable between laterally expanded and collapsed conditions for varying the volume of the interior of the second flexible tube structure, thereby imparting sequential discharge and intake strokes on said third fluid; and at least one pumping device arranged for pressurizing said one of said first or second fluids.

2. The pump system according to claim 1, wherein said discharge stroke of said first pump serves as the intake stroke of said second pump.

3. The pump system according to claim 2, wherein said intake stroke of said first pump serves as the discharge stroke of said second pump.

4. The pump system according to claim 1, wherein a first fluid storage tank is arranged in fluid connection with a first fluid inlet valve of said first pump.

5. The pump system according to claim 1, wherein a first fluid outlet valve of said first pump is in fluid connection with a third fluid inlet valve of said second pump.

6. The pump system according to claim 5, wherein said first fluid outlet valve of said first pump is in fluid connection with said third fluid inlet valve of said second pump by means of a fluid-ore mixing tank.

7. The pump system according to claim 4, characterized in that a third fluid outlet valve of said second pump is in fluid connection with said first fluid storage tank.

8. The pump system according to claim 5, wherein said first fluid inlet valve of said first pump is in fluid connection with said region of the first interior space surrounding the first flexible tube structure.

9. The pump system according to claim 8, wherein a second fluid inlet valve of said first pump is in fluid connection with the interior of the first flexible tube structure.

10. The pump system according to claim 5, wherein said third fluid inlet valve of said second pump is in fluid connection with the interior of the second flexible tube structure.

11. The pump system according to claim 10, wherein a second fluid outlet valve of said first pump is in fluid connection with said region of the second interior space surrounding the second flexible tube structure by means of a second fluid inlet valve of said second pump.

12. The pump system according to claim 1, wherein at least one of said first or second flexible tube structures is substantially inelastic.

13. The pump system according to claim 1, wherein at least one of said first or second flexible tubes structures is maintained in a taut condition between the ends within said first or second rigid outer casings.

14. The pump system according to claim 1, wherein one end of at least one of said first or second flexible tubes structures is closed and the other end is connected to a port through which either first or second fluid can enter into and discharge.

15. The pump system according to claim 14, wherein the closed end of the tube structure is movably supported to accommodate longitudinal extension and contraction of the tube structure.

16. The pump system according to claim 1, wherein said first fluid is identical to said third fluid.

17. The pump system according to claim 1, wherein a fluid flushing circuit is arranged in fluid communication with the system for clearing particulate and other debris from the system.

18. The pump system according to claim 1, wherein a control system is arranged for controlling the operation of the said valves and pumps in a pre-determined manner.

* * * * *